United States Patent [19]

Bowman et al.

[11] 4,328,615

[45] May 11, 1982

[54] RAZOR BLADE ASSEMBLY WITH MOVABLE COVER CAP

[75] Inventors: Peter Bowman, Sandy Hook; Allan S. Frieze, Woodbridge, both of Conn.

[73] Assignee: Warner-Lambert Company, Morris Plains, N.J.

[21] Appl. No.: 108,747

[22] Filed: Dec. 31, 1979

[51] Int. Cl.[3] ..... B26B 21/06

[52] U.S. Cl. ..... 30/32; 30/47; 30/84

[58] Field of Search ..... 30/30, 32, 47, 50, 84, 30/66, 77, 286

[56] References Cited

U.S. PATENT DOCUMENTS

| | | | |
|---|---|---|---|
| 1,287,338 | 12/1918 | King | 30/66 |
| 2,122,263 | 6/1938 | Pinter | 30/286 X |
| 2,580,142 | 12/1951 | Voight | 30/286 X |
| 2,744,319 | 5/1956 | Cutler | 30/84 X |
| 3,289,295 | 12/1966 | Tornvall | 30/30 |
| 3,646,672 | 3/1972 | Braginetz | 30/32 |
| 3,754,325 | 8/1973 | Tornvall | 30/30 |
| 3,899,928 | 8/1975 | Bosco | 30/286 X |
| 4,037,321 | 7/1977 | Iten | 30/47 |

*Primary Examiner*—Nicholas P. Godici
*Attorney, Agent, or Firm*—R. S. Strickler

[57] ABSTRACT

A razor blade assembly is provided including a pair of skin-engaging structural elements, the razor blade being connected to a first one of the skin-engaging elements with the cutting edge forwardly directed. The second skin-engaging element is movably connected to the first and being movable relative to both the blade and the first skin-engaging element between first and second positions. In the first position the blade is exposed for shaving. That is the blade edge extends forwardly of a tangent plane to the front margins of the two skin-engaging elements. In the second position the blade is in a guarded position, that is rearward of the tangent plane. Preferably the first skin-engaging element is a guard bar and the second skin-engaging element is a cap member.

8 Claims, 16 Drawing Figures

RAZOR BLADE ASSEMBLY WITH MOVABLE COVER CAP

BACKGROUND OF THE INVENTION

The invention is directed to a novel safety razor construction and more particularly directed to a shaving unit or razor blade assembly having a movable cap.

Since the introduction of the safety razor, the shaving unit or blade assembly has consisted principally of three members, namely, a blade, a guard bar and seat combination connected, or connectable, to a handle, and a cap. The function of the guard bar/seat and the cap is to properly locate and hold the blade in the proper location for cutting hair in controlled contact with the skin. Generally these elements have been manufactured as separate components which, when removably attached or fixedly attached to the handle, combine to maintain desired geometry in relationship to these elements during the act of shaving.

Of more recent development is the bonded cartridge or razor blade assembly in which the seat, cap and blade are permanently and rigidly bonded together to achieve and maintain a desired shaving geometry and fixed relationship of the parts. In this arrangement, the cartridge is adapted to be coupled as a complete and unitary assembly to the handle. This type of configuration is exemplified and disclosed in U.S. Pat. No. 3,783,510, which employs a tandem or twin blade assembly with a spacer therebetween permanently and rigidly bonded to a cap and platform member, the platform member or seat having an integral guard bar and coupling members for attachment to the handle.

Similarly, so-called disposable razors are known which employ all or most of the features of a bonded cartridge blade assembly and which also incorporate the handle with the blade assembly in a non-detachable manner, as by integrally molding it with the seat.

Except for those razors in which a blade is loaded or fixed therein by the user just prior to shaving, it is generally desirable to provide some form of protective cover for blade assemblies to prevent contact of the blade edge with various external elements which might either be hard enough to do harm to the blade edge or otherwise be sufficiently soft to be cut, as the skin of a user or handler. In the instance of the aforementioned bonded cartridges, they have typically been marketed in multicompartmented dispensers, such as disclosed in the aforementioned U.S. Pat. No. 3,783,510, which isolate the blade edges until they are ready for use. The so-called disposable razors have also been provided with protective covers which normally take the form of a singly-compartmented cover which removably fits over at least the cap and blade portions of the razor.

A disposable safety razor recently introduced in Japan by the Kai Safety Razor Company, Ltd. under the identification MC2-200 does provide certain movable elements which cooperate to either expose the blade edge for shaving or relatively cover it for safe handling. That capability is afforded by providing an integrally formed seat member and handle, a blade(s) fixed to a movable platform which includes an integral guard bar member, and a cap which snap-locks with the seat member. A cam member is rotatably connected to the seat member and in camming engagement with the blade platform so as to move the platform, guard bar and blades(s) back and forth (in and out) relative to the cap and seat member when manually rotated. However, it will be appreciated that such a mechansim makes a relatively complex, and presumably costly, structure of an otherwise simple, and presumably less expensive, disposable razor.

Also, there have been a variety of efforts to provide blade assemblies in which the desired geometry of the blade relative to the cap and/or seat and guard elements may be varied. The geometrical parameters which are believed to play the greatest role in shaving comprise blade exposure, blade tangent angle, and span angle. These terms are defined as follows: The blade exposure is the normal distance the blade edge extends beyond or back from a plane tangent to the cap and the guard bar; the blade tangent angle is the angle formed between a plane tangent to the blade edge and the guard bar and a second plane bisecting the blade edge; and the span angle is the distance measured between the blade edge and a tangent point on the guard bar. One such device is described in U.S. Pat. No. 3,500,539 wherein a transversely arrayed guard bar is connected to the blade platform by a yieldable web structure. In yet another example, that of U.S. Pat. No. 4,063,354, there is described a shaving unit in which the guard element and/or the cap element may be resiliently moved relative to the blade and seat assembly in response to shaving forces. These blade assemblies, however, are also relatively complex and do not address the problem of providing a protective cover for the blade edges.

Accordingly, it is a principal object of the present invention to provide an improved razor blade assembly in which the cap element may additionally serve as a protective blade cover. Included within this object is the provision of such dual purpose cap in a razor blade assembly which is relatively simple and inexpensive to manufacture and assemble.

It is a further object of the invention to provide a razor blade assembly having a movable cover cap which provides stability to the blade therebeneath.

SUMMARY OF THE INVENTION

In accordance with the present invention there is provided a razor blade assembly including a pair of skin-engaging structural elements, a razor blade with a cutting edge, the razor blade being fixedly connected to a first one of the skin-engaging elements with the cutting edge forwardly directed, and the second of the skin-engaging elements being movably connected to the first and being movable relative to both the blade and the first skin-engaging element between first and second positions such that a plane tangent to the front margins of the two skin-engaging elements is moved in a generally fore-and-aft direction relative to the cutting edge of the blade to respective first and second positions of the tangent plane for varying the exposure of the edge relative to the plane. Specifically, the blade cutting edge extends forwardly of the tangent plane in the first tangent plane position for providing a positive blade edge exposure for shaving and the blade cutting edge is located rearwardly of the tangent plane in the second tangent plane position to provide a negative blade cutting edge exposure for effectively removing the edge from inadvertent external contact. The first skin-engaging structural element is preferably a guard bar and seat combination and the second is preferably a cap member. The cap and seat members include cooperating slidable retaining means for maintaining the cap in close slidable proximity with the blade. The guard bar and seat are preferably integrally formed with a molded plastic handle.

The present razor blade assembly provides a relatively simple and inexpensive shaving system which extends the function of the cap member to that of protective blade edge cover as well. The present assembly requires relatively few parts, to wit, a guard/seat combination, a cap slidably joined to the seat, and a blade. In a twin blade configuration, only an additional blade and spacer are required. The cap and seat are cooperatively slidably joined in a manner and with structure which enable the cap to double as a protective blade edge cover without requiring additional camming and/or blade supporting structure. Cantilevered retaining lugs at each end of the cap include respective camming surfaces. Complementary retaining flanges at opposite ends of the seat member include respective complementary camming surfaces for outwardly displacing the retaining lugs as the cap is moved relatively downward thereover to a final position in which the retaining lugs and flanges snap-lock into opposed retaining relationship with one another. A slide channel on the seat permits relative fore-and-aft sliding of the cap. Complementary detenting structures on the cap and seat serve to releasably maintain the cap at at least two particular such fore-and-aft positions relative to the seat.

DESCRIPTION OF THE PREFERRED EMBODIMENTS

Figure 1:
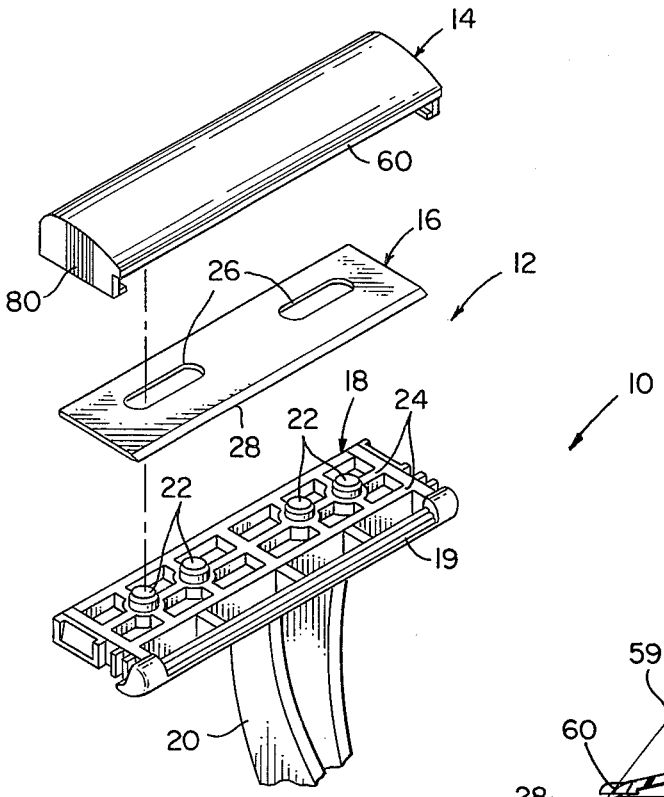
FIG. 1 is an exploded fragmentary view of a single blade razor assembly made in conformity with the present invention.

Referring to FIG. 1, there is illustrated an exploded view of a shaving system 10 in accordance with the present invention. More particularly, the embodiment illustrated in FIG. 1 includes a razor blade assembly 12 comprised of a plastic cap 14, a single blade 16, and a plastic seat member 18 which includes a guard member 19 integrally formed therewith. Moreover, seat member 18 is integrally formed with molded plastic handle 20. Four vertically extending posts 22 are linearly arrayed across the upper, substantially planar blade supporting surface 24 of seat member 18. Holes 26 in blade 16 fit downwardly over the posts 22 such that the blade 16 is precisely aligned with its cutting edge 28 directly forwardly in conventional cutting relationship. The posts 22, in addition to aligning blade 16, extend beyond the upper surface of the blade and are subsequently flared over, as by impact staking, to bond the blade in fixed position on the support surface 24 of the seat member 18. The cap 14 is in snap-fitted slidable engagement with the seat 18 for selective fore-and-aft movement between a retracted shaving position and an advanced protective position to be described hereinafter in greater detail. Thus it is seen that a relatively simple three-piece razor with slidable protective cap cover is afforded by the invention.

For a better understanding of the manner in which the seat 18 and cap 14 are constructed to afford relative sliding relationship, reference is made to FIGS. 2, 3 and 4–10 generally. The seat member 18 is best understood by reference to FIGS. 8–10, which illustrate seat member 18 to be a relatively thin rectilinear element extending transversely of the razor handle 20 in a well-known manner. The guard bar 19 is transversely arrayed along the front margin of seat 18 and is connected therewith by a plurality of support ribs 30. Guard bar 19 serves as the leading skin-engaging member of the razor blade assembly. The blade supporting surface 24 of seat 18 is substantially planar and is defined by several ridges extending transversely the length of the seat member and a larger number of similar ridges extending from front to rear and arrayed from one end of the seat member to the other. Between these ridges, the seat member 18 is of relatively thin vertical thickness, thereby creating the material-saving voids or recesses 25 illustrated in FIGS. 8 and 10.

Important to the invention are the cap-engaging and detenting structures appearing at the opposite ends of seat member 18. A retaining flange 32 is formed along the rear half of each end of seat 18. The retaining flanges 32 are outwardly inclined in the downward direction to define outwardly facing camming surfaces 33. Retaining flanges 32 are here illustrated as terminating about halfway down the end face of seat member 18, thereby forming a downwardly facing shoulder or surface 34 for retaining engagement with cap 14 as will be hereinafter described. It will be appreciated that the incline of camming surface 33 might be made more gradual and the flange carried to the bottom of seat 18 such that shoulder 34 is formed by the underside of the seat itself.

A series of three vertically extending slots 36, 38 and 40 are formed in each of the opposite ends of seat 18 and are arranged in side-by-side spaced relationship between the guard 19 and the retaining flanges 32. The forward two slots 36, 38 are for detenting the cap 14 and are of similar size, being about 0.030 inch wide and being recessed about 0.035 inch into the ends of the seat member. The rearmost slot 40 is for assembling cap 14 onto seat 18 and is slightly wider than slots 36, 38, being 0.040 inch in width, but extends the same depth into the end of seat member 18. Seat 40 diverges slightly in the upward direction to form a lead-in. The slots 36, 38 and 40 extend approximately halfway down the end faces of seat member 18, at which point the end face of the seat member in the region of the slots is inwardly recessed to the depth of slots 36, 38 and 40. The resulting undersurfaces 34' of the lands which define slots 36, 38 and 40 also provide retaining engagement for cap 14 as will be hereinafter described.

The cap 14, as illustrated in FIGS. 4–7, is generally of known rectilinear form with the exception of the several hereinafter described modifications required for the cap to slidingly engage seat 18. The undersurface 41 of cap 14 is substantially planar for uniform bearing contact with the upper surface of a blade 16. Cap surface 41, however, does include four domed recesses or slots 42 therein which extend from very near the leading edge of the cap to very near the trailing edge thereof. Slots 42 are positioned in alignment with the respective posts 22 on seat 18 and are of sufficient fore-to-aft length to allow the requisite relative sliding motion therebetween.

Figure 2:
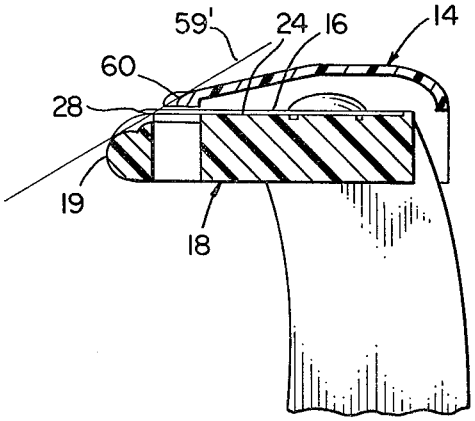
FIG. 2 is a diagrammatic cross-sectional view of a razor blade assembly showing the cap in a retracted shaving position.
Figure 4:
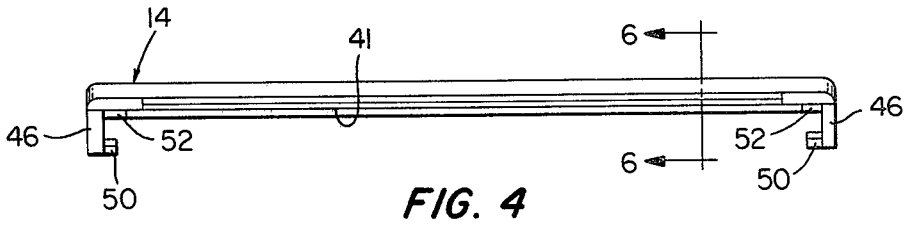
FIG. 4 is a front elevational view of a cap in the razor blade assembly of FIG. 1.
Figure 5:
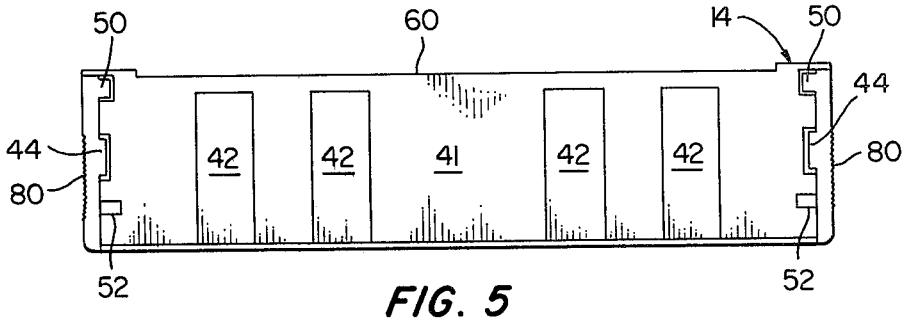
FIG. 5 is an underside view of the cap of FIG. 4.
Figure 6:
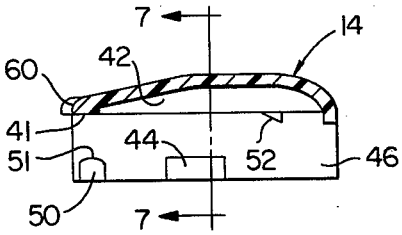
FIG. 6 is a sectional view of the cap of FIG. 4 taken along line 6—6 thereof.
Figure 7:
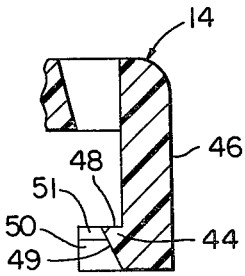
FIG. 7 is a sectional view of FIG. 6 taken along line 7—7 thereof.
Figure 8:
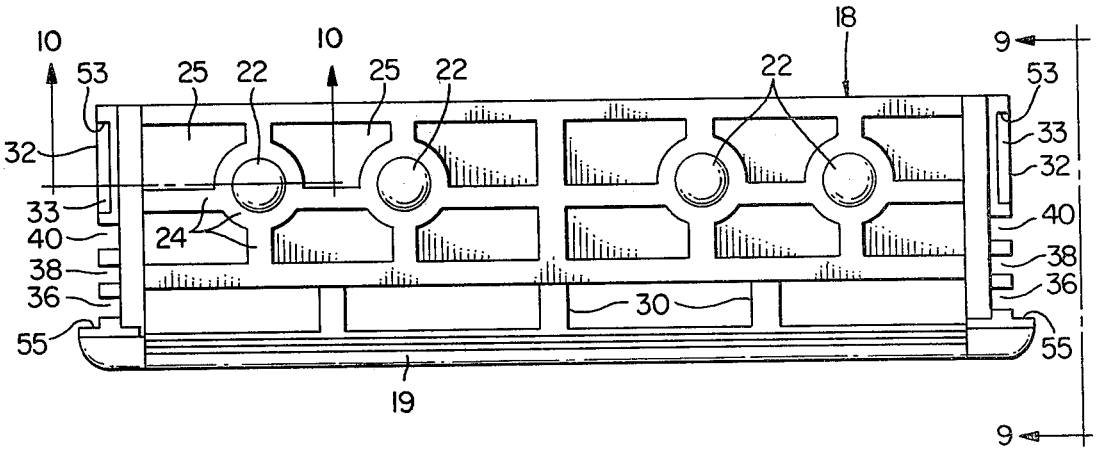
FIG. 8 is a top plan view of a seat member with guard bar in the razor blade assembly of FIG. 1.
Figure 10:
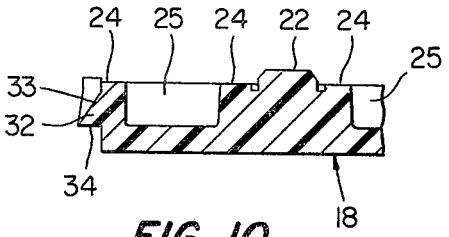
FIG. 10 is a sectional view of the seat member of FIG. 8 taken along line 10—10 thereof.
Figure 9:
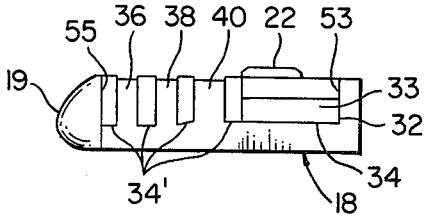
FIG. 9 is a side elevation of the seat member of FIG. 8.
Figure 11:
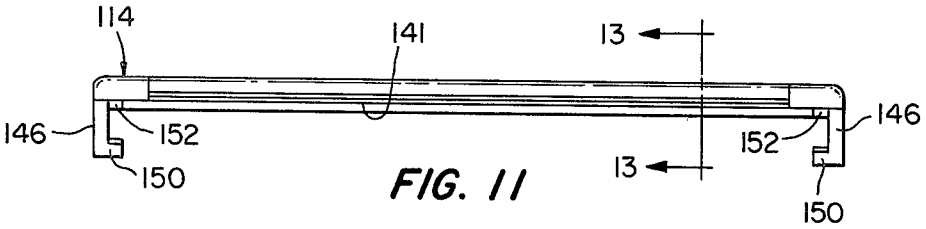
FIG. 11 is a front elevational view of a cap for a twin blade razor assembly in accordance with the invention.
Figure 12:
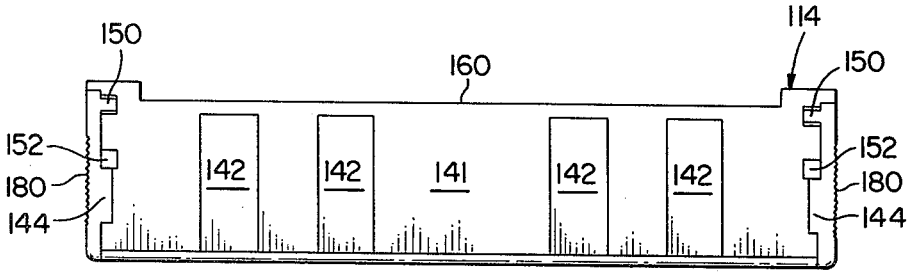
FIG. 12 is an underside view of the cap of FIG. 11.
Figure 13:
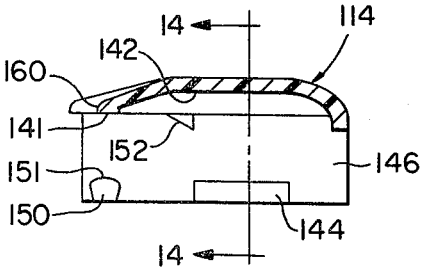
FIG. 13 is a sectional view of the cap of FIG. 11 taken along line 13—13 thereof.
Figure 14:
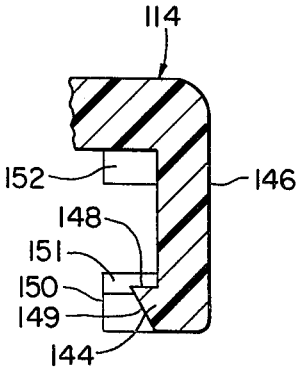
FIG. 14 is a sectional view of the cap of FIG. 13 taken along line 14—14 thereof.
Figure 15:
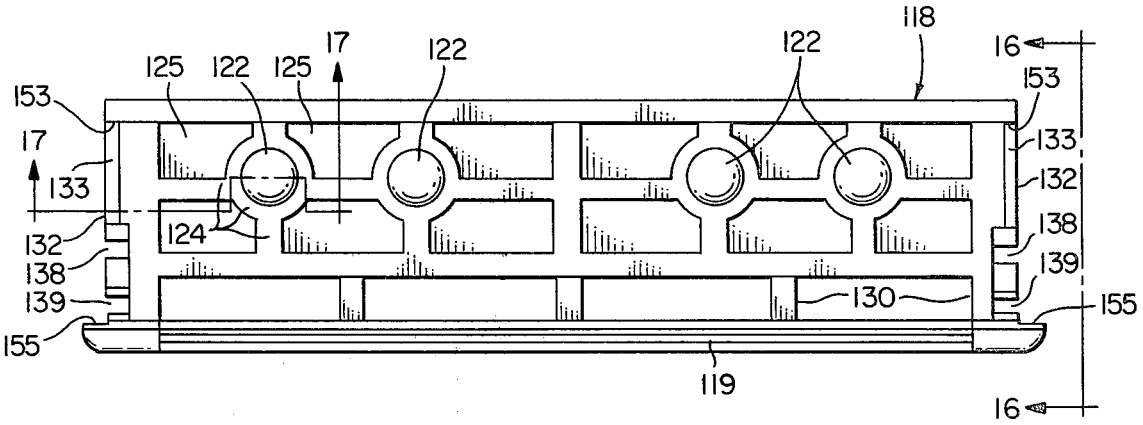
FIG. 15 is a top plan view of a seat member with guard bar for use in a twin bladed razor assembly in accordance with the invention.
Figure 17:
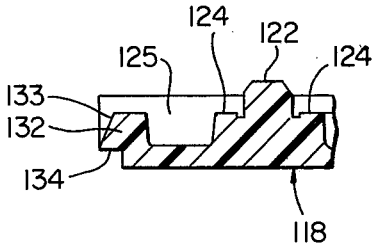
FIG. 17 is a sectional view of the seat member of FIG. 15 taken along line 17—17 thereof.
Figure 16:
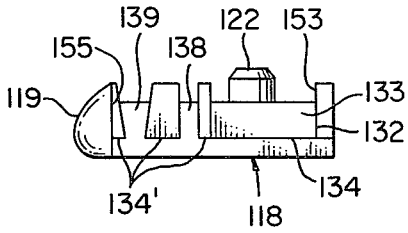
FIG. 16 is a side elevation of the seat member of FIG. 15.

A retaining lug 44 is formed at each of the opposite ends of cap 14 for cooperative retaining engagement with the retaining flanges 32 at the opposite ends of seat 18. Each retaining lug 44 is positioned at the lower inner extremity of a respective end flange 46 which depends in cantilevered fashion from a respective end of cap 14. Each retaining lug 46 extends along about the middle one-third of cap end flange 44 and includes an upwardly facing shoulder or surface 48 for opposed retaining contact with the downwardly facing shoulder 34 of seat 18. Each retaining lug 44 also includes an inwardly facing camming surface 49 which inclines relatively outward in the downward direction for complementary camming engagement with the respective camming surfaces 33 on seat 18. The respective elevations of shoulder 34 on seat 18 and shoulder 48 on cap 14 are selected such that the cap's planar bearing surface 41 is urged into and maintained in contact with the upper surface of blade 16 when the two retaining surfaces are in operative slidable engagement. The undersurface 41 of cap 14 (FIGS. 4 and 5) and the shoulder or surface 48 (FIG. 7) define a slide which moves along a track or slideway defined by the assembled blade 16 and seat member 18 (FIG. 2).

A latch or detent member 50 is formed on the interior surface of each cap end flange 46 toward the forward, lower extremes thereof. Detent members 50 project inwardly about 0.03 inch from the interior surface of end flanges 46 and include an upwardly facing generally arcuate surface 51 extending in a fore-and-aft direction and of sufficient extent to more than span the widths of seat slots 36 and 38 but of slightly lesser extent than the width of seat slot 40. The elevation of surface 51 on detent members 50 and the corresponding undersurfaces 34' adjacent the lower ends of slots 36, 38 and 40 on seat 18 are selected such that detent surfaces 51 extend somewhat above the land undersurfaces 34' on seat 18 such that the detent members 50 are detentingly received in the detent slots 36 and 38.

A pair of stop members 52 extend downwardly a short distance from the planar undersurface 41 of cap 14 toward its rear margin at the opposite ends thereof. A rearwardly facing stop surface on each of the stop members 52 is positioned to contact a respective forwardly facing stop surface 53 on the seat member 18 to limit relative rearward sliding motion of cap 14. The stop surface 53 is provided by vertically relieving the upper surface of seat 18 at its ends along the length of its retaining flange 32. Similarly, the forward margins of cap end flanges 46 may abuttingly contact rearwardly facing surfaces 55 at the extreme ends of guard bar 19 to limit the relative forward sliding motion of cap 14. The positions of these above-described stops are selected to embrace the sliding range which includes detent slots 36 and 38.

The unnumbered voids extending through the horizontal major portion of cap 14 directly above detent members 50 and retaining lugs 44 exist only for the purpose of facilitating the molding of the cap 14, and serve no other function in the practice of the invention. These voids are required if a so-called top molding process is used. On the other hand, the cap appearing in FIGS. 11–14 to be hereinafter described have been illustrated without such mold openings to illustrate the use of an alternative so-called side molding process for forming the cap.

A conventional blade 16, having a typical thickness in the range of 0.004–0.010 inch, but preferably being between about 0.006 and 0.010 inch in this embodiment, is bonded to seat 18 by staking the posts 22. Then the cap 14 is urged down over seat 18 in an orientation which places detent member 50 in vertical registry with assembly slot 40 and retaining lug 44 in registry with retaining flange 32. As cap 14 is moved relatively downward, the seat's camming surfaces 33 act on the cap's camming surfaces 49 to resiliently displace the cantilevered cap end flanges 46 and their retaining lugs 44 relatively outward until the seat's retaining shoulders 34 are reached by the cap's retaining shoulders 44, whereupon end flanges 46 will abruptly snap inwardly, placing retaining shoulders 48 in retained engagement with retaining shoulders 34. Similarly, the upper surface 51 of detent 50 will have moved to a position very near the bottom of assembly slot 40.

By applying a forward force to cap 14 relative to seat 18, the detent 50 may be urged forwardly beneath one of the lands 34' and into a first detented position within detent slot 38. Upon the further application of a forwardly directed force to cap 14, the detent member 50 may be urged out of detent slot 38 and over the next adjacent land 34' and into a detented position within detent slot 36. A series of vertically extending serrations 80 in the end flanges 46 of cap 14 aid the user in grasping the cap between thumb and forefinger and sliding it relatively forward or back.

Figure 3:
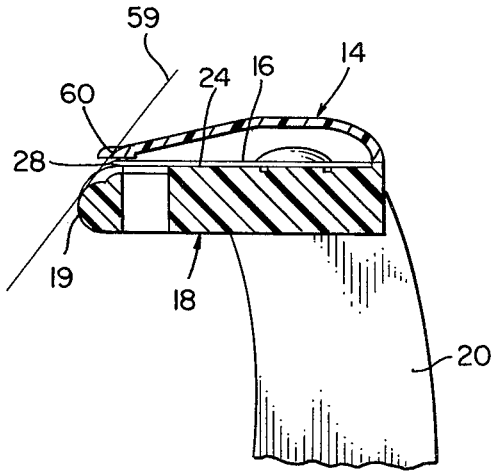
FIG. 3 is a diagrammatic cross-sectional view of a razor blade assembly showing the cap in an advanced protective position.

The relatively forward detented position represented by detent slot 36 places the cap in a so-called "advanced" position, illustrated in FIG. 3, in which a plane 59 tangent to the forward skin-engaging margin 60 of cap 14 and the guard bar 19 of seat 18 is located forwardly (above) of the cutting edge 28 of blade 16 to cover and protect the blade edge.

Detent 50 of cap 14 is moved to the rearward detent slot 38, the tangent plane 59', illustrated in FIG. 2, now passes rearwardly (below) the cutting edge 28 of blade 16, thereby placing the edge in a suitable shaving configuration. Typically, the exposure of blade edge 28 when cap 14 is in its retracted position is about 0.002 inch, that distance being measured along the line normal to plane 59' and extending through blade edge 28. The pitch between detent slots 36 and 38 is sufficient to ensure adequate protective covering of blade edge 28 when the cap 14 is moved to its "advanced" position. In the illustrated embodiment, the pitch between detent slots 36 and 38 is about 0.055 inch such that the plane 59 of FIG. 3 passes about 0.018 inch forwardly of blade edge 28, as measured above.

FIGS. 11–17 illustrate a second embodiment of the invention suited for use with the twin blade shaving system. Conceptionally, the twin blade embodiment of FIGS. 11–17 are the same as the single blade embodiment of FIGS. 1–10; however, various minor modifications do exist in the cap and seat structures because of the presence of a second blade and a spacer. Neither the second blade nor the spacer have been illustrated inasmuch as twin bladed razor blade assemblies employing a spacer between the seat and cap blades are well known and the present invention does not alter that arrangement of the blades. It will be appreciated that the presence of a spacer and the additional cap blade will lend increased rigidity to the assembly, thereby allowing the use of thinner blades than might be required for the single blade embodiment. Typically the cap and seat blades will each be about 0.004 inch thick. In order to simplify the discussion of the twin bladed embodiment, those elements of FIGS. 11–17 which are direct analogs of elements in the FIGS. 1–10 embodiment will bear the identical reference numeral preceded by a "1". Accordingly, only those elements of the present embodiment which differ from the single blade embodiment or require further explanation will be described hereinafter.

Firstly, it will be appreciated that staking posts 122 are longer than staking posts 22 inasmuch as they are required to pass through two razor blades and a spacer, rather than a single razor blade. It will also be understood that the uppermost or cap blade (not shown) is generally narrower than the seat blade such that its cutting edge is set back from or follows the cutting edge of the seat blade in a manner and by an amount well known in the art. It will be noted in FIGS. 15 and 16 that instead of three vertically extending slots in each end of seat 118 this embodiment provides only two such slots; a rearward slot 138 is analogous to the detenting slot 38 of the foregoing embodiment which served to define the "retracted" or "shaving" position of the cap 14 therein. However, instead of providing separate assembly slots 40 and "advanced" detenting slots 36, the seat 118 of the present embodiment combines both functions in a single forward slot numbered 139 herein. It will be noted that this forward slot 139 is slightly divergent in the upward direction to form the desired lead-in taper for an assembly slot. On the other hand, slot 139 is of substantially the same width as its lower extreme as rear detent slot 138 such that it may serve effectively as the forward detenting slot. Typically this width of the detenting slot is about 0.03 inch whereas the corresponding width of the detent 150 is somewhat greater, as for instance 0.035 or 0.040 inch. However, despite the greater width of detent 150, there is sufficient resiliency to the detent member, and to the walls of slot 139 as well as sufficient outward deflection of the detent member during assembly such that the loading of that detent via the assembly slot 139 is possible. Because the present embodiment includes a pair of blades arranged such that the cap blade is set back from the seat blade, it is necessary that the range of sliding displacement of the cap 114 relative to the seat 118 be substantially greater than the single blade embodiment. Therefore, the pitch between the detent slots 139 and 138 is about 0.090 inch.

Referring to the cap 114 for this embodiment depicted in FIGS. 11–14, several differences from the single blade embodiment will be noted. The slots 142 in the undersurface 141 of cap 114 are of substantially the same depth as were slots 142 in cap 14. Slots 142 are also of about the same length as slots 42 because the need for a rearwardly displaced assembly slot 38 in the seat has been avoided by combining it with the detent slot 139. The end flanges 146 depend from the transverse section of cap 114 to a greater extent than for the single bladed embodiment due to the additional thickness of the spacer and cap blade. Additionally, the stop members 152 depending from the cap surface 141 are positioned forwardly of the stops 52, toward the midline of the cap. These stops 152 similarly have rearward facing stop surfaces positioned to engage complementary forward facing stop surfaces 153 on the seat 118.

As for the single bladed assembly, the twin bladed assembly of FIGS. 11–17 is assembled in somewhat the same manner; however, the detent 150 is now positioned above the combination assembly and detent slot 139 for assembly with the seat 188 in that position. Therefore, immediately upon assembly, the cap 114 will be in the "advanced" position in which the tangent plane (not shown here) is spaced forwardly of the leading, or seat, blade by about 0.018 inch. Cap 114 may then be manually rearwardly slid or displaced until detent 150 enters detented engagement with slot 138. In this position, the tangent plane (not shown) exposes both the cap and the seat blade sufficiently for shaving, such exposure typically being 0.0025 inch. As was the case with the single bladed embodiment, the retaining lug 144 and the retaining flange 132 are of sufficient fore-to-aft length that their respective retaining surfaces 148 and 134 provide continuous retaining engagement between cap 114 and seat 118 over the full sliding range between the "advanced" and "retracted" positions.

The present embodiments are to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A razor blade assembly comprising:

lower blade supporting means, said lower blade supporting means including a seat member having a skin-engaging guard surface along the forward margin thereof and an upwardly facing planar support surface;

at least one razor blade having a cutting edge;

means rigidly and permanently connecting said at least one razor blade in fixed supported engagement with said planar support surface, said at least one razor blade cutting edge being forwardly directed; and blade cover means comprising a cap member disposed above said at least one razor blade and having a forward margin and being movably retainedly connected to said seat member, said cap member being movable in a fore-and-aft direction relative to said at least one razor blade and said planar support surface between a first position in which said at least one razor blade cutting edge extends forwardly beyond a plane tangent to forward margins of said cap member for shaving and a second position in which said plane tangent is relatively moved to a position forward of said at least one razor blade cutting edge thereby to effectively remove said at least one razor blade cutting edge from inadvertent external contact wherein said cap member and said seat member include complementary detenting means for releasably retaining said cap member at each of said first and second positions, said detenting means comprises first engaging means on each end of one of said cap member and said seat member for releasably engaging second and third engaging means respectively on each end of the other of said cap member and said seat member when said cap member is in said first and second positions respectively.

2. The razor blade assembly of claim 1 wherein said first engaging means is formed on said cap member and said second and third engaging means are formed on said seat member.

3. The razor blade assembly of claim 1 wherein said first engaging means comprises a projection and said second and third engaging means comprise recesses.

4. The razor blade assembly of claim 2 wherein said first engaging means comprises a projection and said second and third engaging means comprise recesses.

5. The razor blade assembly of claim 1 wherein one of said cap member and said seat member includes a retaining lug and the other includes a complementary flange, said retaining lug and said flange being relatively configured and positioned for close sliding engagement so as to retain said cap member in close proximity with said blade and afford relative sliding motion therebetween transversely to said blade edge in a plane parallel to said blade.

6. The razor blade assembly of claim 1 wherein said cap member and seat member each include respective complementary stop surfaces for limiting said sliding motion to a range which includes said first and second positions of said cap member relative to said seat member.

7. The razor blade assembly of claim 5 wherein said retaining lug and said flange include respective vertically opposed surfaces positioned to oppose vertical separation of said cap member and said seat member, said cap member and said seat being formed of plastic, and one of said retaining lug and said flange being cantilevered to its respective said cap member or seat member, said cantilevered retaining lug being sufficiently resilient to be relatively passed over said flange and snapped into said separation-opposing relation therewith.

8. The razor blade assembly of claim 7 wherein said retaining lug and said flange include respective opposed camming surfaces, said camming surfaces being inclined such that relative vertical motion between said cap member and said seat member is translated into a horizontal displacement of said cantilevered retaining lug or flange.

* * * * *